US008081120B2

(12) United States Patent
Yoshioka

(10) Patent No.: US 8,081,120 B2
(45) Date of Patent: Dec. 20, 2011

(54) BROADBAND ANTENNA UNIT COMPRISING A FOLDED PLATE-SHAPED MONOPOLE ANTENNA PORTION AND TWO CONDUCTIVE ELEMENTS

(75) Inventor: Hiroki Yoshioka, Tokyo (JP)

(73) Assignee: Mitsumi Electric Co., Ltd., Tama-Shi, Tokyo (JP)

( * ) Notice: Subject to any disclaimer, the term of this patent is extended or adjusted under 35 U.S.C. 154(b) by 465 days.

(21) Appl. No.: 12/236,659

(22) Filed: Sep. 24, 2008

(65) Prior Publication Data

US 2009/0079638 A1 Mar. 26, 2009

(30) Foreign Application Priority Data

Sep. 26, 2007 (JP) ..... 2007-248328

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS

| | | | | |
|---|---|---|---|---|
| 6,535,170 | B2 | 3/2003 | Sawamura et al. | |
| 6,847,328 | B1 * | 1/2005 | Libonati et al. | 343/700 MS |
| 6,914,561 | B2 | 7/2005 | Kuroda et al. | |
| 7,081,859 | B2 | 7/2006 | Miyoshi et al. | |
| 2001/0022559 | A1 | 9/2001 | Takahashi et al. | |
| 2004/0012530 | A1 | 1/2004 | Chen | |
| 2006/0017620 | A1 | 1/2006 | Chen et al. | |
| 2006/0139214 | A1 * | 6/2006 | Deng et al. | 343/700 MS |
| 2006/0293078 | A1 | 12/2006 | Qi et al. | |
| 2007/0040754 | A1 * | 2/2007 | Liu et al. | 343/702 |
| 2007/0103373 | A1 | 5/2007 | Wallace et al. | |
| 2008/0094285 | A1 | 4/2008 | Hansen | |
| 2008/0198075 | A1 | 8/2008 | Yoshioka | |

FOREIGN PATENT DOCUMENTS

| | | | |
|---|---|---|---|
| EP | 1 133 001 | A2 | 9/2001 |
| EP | 1 764 866 | A1 | 3/2007 |
| JP | 9-223921 | A | 8/1997 |
| JP | 11-068453 | A | 3/1999 |
| JP | 2002-185238 | A | 6/2002 |

(Continued)

OTHER PUBLICATIONS

Extended European Search Report dated Jan. 12, 2009 issued in counterpart European Appln. No. 08164806.5.

(Continued)

*Primary Examiner* — Dieu H Duong
(74) *Attorney, Agent, or Firm* — Holtz, Holtz, Goodman & Chick, P.C.

(57) ABSTRACT

In a broadband antenna unit including a ground plate, an antenna element disposed in the vicinity of an end of the ground plate, and a dielectric substrate for mounting the antenna element therein, the antenna element includes a folded plate-shaped monopole antenna portion having a U-shape in cross section, a first conductive element extending from a first location of the folded plate-shaped monopole antenna portion, and a second conductive element extending from a second location of the folded plate-shaped monopole antenna portion. The antenna element is disposed on the side of one side edge of the ground plate. The broadband antenna unit has a feeding point between the ground plate and the antenna element that is disposed at a feeding position apart from the one side by a predetermined distance.

10 Claims, 10 Drawing Sheets

FOREIGN PATENT DOCUMENTS

| | | | |
|---|---|---|---|
| JP | 2003-273638 | A | 9/2003 |
| JP | 2003-283233 | A | 10/2003 |
| JP | 2003-304114 | A | 10/2003 |
| JP | 2003-304115 | A | 10/2003 |
| JP | 2005-094437 | A | 4/2005 |
| JP | 2005-184704 | A | 7/2005 |
| JP | 2005-252526 | A | 9/2005 |
| JP | 2007-88849 | A | 4/2007 |
| JP | 2008-236710 | A | 10/2008 |
| WO | WO 2006/063916 | A1 | 6/2006 |
| WO | WO 2007/028448 | A1 | 3/2007 |

OTHER PUBLICATIONS

Japanese Office Action dated Oct. 7, 2009 (4 pages), and partial English translation thereof (4 pages), issued in counterpart Japanese Application Serial No. 2007-248328.

Hattori, Satoshi et al, "An Elliptically Shaped Ring Broadband Antenna", 2005 National Convention of the Institute of Electronics, Information and Communication Engineers of Japan as Paper No. B-1-104, Osaka, Japan May 2005.

Hattori, Satoshi et al, "An Elliptically Shaped Ring Broadband Antenna—Part II", 2005 Communication Society Convention of the Institute of Electronics, Information and Communication Engineers of Japan as Paper No. B-1-82, Hokkaido, Japan, Sep. 2005.

Hattori, Satoshi et al, "An Elliptically Shaped Ring Broadband Antenna—Part III", 2006 National Convention of the Institute of Electronics, Information and Communication Engineers of Japan as Paper No. B-1-165, Tokyo, Japan May 2006.

* cited by examiner

BROADBAND ANTENNA UNIT COMPRISING A FOLDED PLATE-SHAPED MONOPOLE ANTENNA PORTION AND TWO CONDUCTIVE ELEMENTS

This application is based upon and claims the benefit or priority from Japanese patent application No. 2007-248328, filed on Sep. 26, 2007, the disclosure of which is incorporated herein its entirety by reference.

BACKGROUND OF THE INVENTION

This invention relates to a broadband antenna unit and, more particular, to a broadband antenna unit included in a mobile equipment terminal and an antenna element for use in it.

An ultra wideband (UWB) technology means an ultra wideband radio technology like its name and is defined as any radio technology having a spectrum that occupies a bandwidth greater than 25 percent of the center frequency, or a bandwidth of at least 1.5 GHz. In a word, the UWB technology is technology for communicating using short pulses (normally each having a pulse width of 1 ns or less) of ultra wideband so as to start a revolution in radio technology.

A crucial difference between a conventional radio technology and the UWB technology is the presence or absence of a carrier wave. The conventional radio technology modulates a sinusoidal wave having a frequency called the carrier wave using various methods to transmit and receive data. On the other hand, the UWB technology does not the carrier wave. In the manner which is written in definition of the UWB technology, the UWB technology uses the short pulses of the ultra wideband.

Like its name, the UWB technology has a frequency band of the ultra wideband. On the other hand, the conventional radio technology has only a narrow frequency band. This is because it is possible, with the narrow frequency band, to effectively utilize electric waves. The electric waves are finite resources. The reason whey the UWB technology is widely noticed in spite of the ultra wideband is output energy of each frequency. The UWB technology has a very small output at each frequency although a frequency band is wide. Inasmuch as the output of the UWB technology has such a magnitude as to be covered with noises, the UWB technology reduces interference with other wireless spectra. In the United States, the Federal Communications Commission (FCC) has mandated that UWB radio transmissions can legally operate in range from 3.1 GHz to 10.6 GHz, at a limited transmit power of −4.1 dBm/MHz.

In addition, antennas basically use a resonance phenomenon. The antenna has a resonance frequency which is determined by its length. However, it is difficult for the UWB including a lot of frequency components to make the antenna for UWB resonate. Accordingly, the wider the frequency band of the electric wave to be transmitted is, the more difficult it is to make a plan or design for the antenna for UWB.

Taiyo Yuden Co. Ltd. has successfully developed a very miniaturized ceramic chip antenna having a size of 10×8×1 mm for ultra wideband applications. Since UWB technology was released by the FCC commercial use, it has been hailed as the short-range wires-communication standard of the future. For one thing, it promises to simultaneously provide a high data rate and low power consumption. By sending very low-power pulses below the transmission-noise threshold, UWB also avoids interference. By developing the antenna, it has become the responsibility of the wireless industry to help UWB make the transition from military applications to widespread commercial use for connecting at a very high speed data between digital devices such as PDP (plasma display panel) television, a digital camera, or the like.

In addition, such a UWB antenna can be used for various purposes such as Bluetooth (registered trademark), wireless LAN (local area network), or the like.

Bluetooth (registered trademark) technology is a cutting-edge open specification that enables short-range wireless connections between desktop and notebook computers, handhelds, personal digital assistants, mobile phones, camera phones, printers, digital cameras, handsets, keyboards and even a computer mouse. Bluetooth wireless technology uses a globally available frequency band (2.4 GHz) for worldwide compatibility. In a nutshell, Bluetooth technology unplugs your digital peripherals and makes cable clutter a thing of the past.

The wireless LAN is an LAN using a transmission path except for a wire cable, such as electric waves, infrared rays, or the like.

Various broadband antenna devices are already known in the art. By way of example, JP 2003-273638 A discloses a wideband antenna device with which interference to be exerted by an unwanted frequency band or a frequency band out of a target is reduced by forming the wideband antenna device matched with target frequency characteristics. According to JP 2003-273638 A, the wideband antenna device comprises a flat conductive ground plate and a flat radiation conductor standing up above a plane of the flat conductive ground plate in a direction to intersect the flat conductive ground plate. The wideband antenna device has a feeding point on or near an outer peripheral portion of the flat radiation conductor. The flat radiation conductor has one or more notches formed by cutting a part of the flat radiation conductor.

In addition, JP 2003-283233 A discloses a wideband antenna device with a wide band and a small size that counters the problems in costs, usage purposes or mounting on equipment and that is capable of cutting manufacturing costs. According to JP 2003-283233 A, the wideband antenna device comprises a flat conductive ground plate and a polygonal flat radiation conductor standing up above a plane of the flat conductive ground plate in a direction to intersect the flat conductive ground plate. The polygonal flat radiation conductor has a top which is used as a signal feeding point.

Furthermore, JP 2003-304114 A discloses a wideband antenna device which uses a plate-shaped radiation conductor as a radiation conductor and which can be made more compact. According to JP 2003-304114 A, the wideband antenna device comprises a flat conductive ground plate and a flat radiation conductor standing up above a plane of the flat radiation ground plate in a direction to intersect the flat conductive ground plate. In a state where the flat radiation conductor stands up above the plane of the flat conductive ground plate, the flat radiation conductor comprises a plurality of conductive portions so as to arrange in the direction to intersect the flat conductive ground plate. Through a low conductivity member having conductivity of almost 0.1 [/Ωm] or more and 10.0 [/Ωm] or less, the plurality of conductive portions are connected.

In the wideband antenna devices disclosed in the above-mentioned JP 2003-273638 A, JP 2003-283233 A, and JP 2003-304114 A, the flat radiation conductor stands up above the plane of the flat conductive ground plate in the direction to intersect the flat conductive ground plate. Therefore, the wideband antenna devices are high in stature and it is difficult to include the wideband antenna device in a portable equipment terminal. In addition, in the above-mentioned JP 2003-

304114 A, the disclosed wideband antenna device has a low limit frequency of 2.32 GHz and cannot support a frequency lower than the low limit frequency.

A thin-type wideband antenna device is disclosed in JP 2003-304115 A which corresponds to U.S. Pat. No. 6,914,561 issued to Shinichi Kuroda et al. According to JP 2003-304115 A, the thin-type wideband antenna device includes a reference conductor (conductive ground plate) and a radiation conductor that are connected with a feeder line for transmitting power, at least parts of which are disposed so as to face each other. Interposed between the parts that the reference conductor and the radiation conductor face each other, a substance has conductivity which is about 0.1 [/Ωm] through 10 [/Ωm] in the operational radio frequency.

However, the thin-type wideband antenna device disclosed in JP 2003-304115 A is disadvantageous in that an operable band is narrow.

On the other hand, an ultra wideband (UWB) antenna unit which is capable of widening the band and which is capable of improving a frequency characteristic has already been proposed in JP 2005-94437 A which corresponds to U.S. Pat. No. 7,081,859 issued to Akira Miyoshi et al. According to JP 2005-94437 A, the UWB antenna unit comprises an upper dielectric, a lower dielectric, and a conductive pattern sandwiched therebetween. The conductive pattern has a feeding point at a substantially center portion of a front surface. The conductive pattern comprises a reversed triangular portion having a right-hand taper part and a left-hand taper part which widen from the feeding point at a predetermined angle toward a right-hand side surface and a left-hand side surface, respectively, and a rectangular portion having a base side being in contact with an upper side of the reversed triangular portion. In addition, the feeding point of the conductive pattern is electrically connected to a ground plate which extends in a plane similar to that of the conductive pattern (a radiation element).

Inasmuch as the UWB antenna unit disclosed in JP 2005-94437 A has a usable frequency band which lies between about 4 GHz and about 9 Hz. Therefore, the usable frequency band is narrow.

Various thin UWB antennas which cover a UWB band between 3.1 GHz and 10.6 GHz are proposed in the art. By way of example, an elliptically shaped ring broadband antenna is reported by Satoshi Hattori et al in a first paper contributed to 2005 National Convention of the Institute of Electronics, Information and Communication Engineers of Japan as Paper No. B-1-104, Osaka, Japan, May, 2005, under the title of "An Elliptically Shaped Ring Broadband Antenna." In the elliptically shaped ring broadband antenna reported in the first paper, an elliptically shaped radiation element has an outside diameter in a major axis direction of 24 mm and a ground plate has a square with a side of 45 mm.

Another elliptically shaped ring broadband antenna is reported by Satoshi Hattori et al in a second paper contributed to 2005 Communication Society Convention of the Institute of Electronics, Information and Communication Engineers of Japan as Paper No. B-1-82, Hokkaido, Japan, September, 2005, under the title of "An Elliptically Shaped Ring Broadband Antenna—Part II." The elliptically shaped ring broadband antenna reported in the second paper comprises a ground plate having a semi-elliptically shaped upper edge.

Still another elliptically shaped ring broadband antenna is reported by Satoshi Hattori et al in a third paper contributed to 2006 National Convention of the Institute of Electronics, Information and Communication Engineers of Japan as Paper No. B-1-165, Tokyo, Japan, May, 2006, under the title of "An Elliptically Shaped Ring Broadband Antenna—Part III." The elliptically shaped ring broadband antenna reported in the third paper comprises a ground plate having a lower portion where both side corner portions are deleted with a central portion left. With this structure, it is possible to improve a gain in a +z direction at or more than a frequency of 9 GHz.

The elliptically shaped ring broadband antennas reported in the first through the third papers cover the UWB band between 3.1 GHz and 10.6 GHz. However, it is difficult to cover a frequency band lower than the UWB band, for example, a frequency band (2.45 GHz band) for use in the wireless LAN, a frequency of 1.575 GHz for use in a global positioning system (GPS), or a frequency band (e.g. 2.1 GHz band) for use in a cellular telephone.

In addition, various antenna devices included in portable wireless terminals are already known in the art. By way of example, a dual band built-in antenna device is disclosed in JP 2002-185238 A which corresponds to U.S. Pat. No. 6,535,170 issued to Masatoshi Sawamura et al. The dual band built-in antenna device disclosed in JP 2002-185238 A is operable in a first frequency band and a second frequency band. The dual band built-in antenna device comprises a ground plane comprising a ground member, a first inverted-L line antenna element for the first frequency band, and a second inverted-L antenna element for the second frequency band. The first and the second inverted-L line antenna elements are so constructed that the elements are extended in respective directions further away from each other as the antenna elements extend further from a starting position set in proximity to a power feed point within a plane parallel to the ground plane. The dual band built-in antenna device further comprises a matching circuit shared with the first and the second inverted-L line antenna elements.

In JP 2002-185238 A, as mobile wireless terminals comprising such dual band built-in antenna devices, following multiplex terminals are intended (targeted). A multiplex terminal which can jointly use PDC (Personal Digital Cellular) operation on 800 MHz band and PHS (Personal Handyphone System) operation on 1.9 GHz has been made commercially availably in Japan. Another multiplex terminal capable of jointly using GSM (Global System for Mobile Communication) operation on 900 MHz band and DCS (Digital Communication System) operation on 1.8 GHz has also been on the market in Europe and Asian countries. Moreover, another multiplex terminal which can operate on both AMPS (Advanced Mobile telephone Service) using 800 MHz band and PCS (Personal Communication Service) using 1.9 GHz band has been on sale in the United States.

In addition, there is UMTS (Universal Mobile Telecommunications System) as the third generation (3G) mobile communications system in Europe.

JP 11-68453 A proposes a composite antenna which has a small external size and which can easily obtain a desired feeding point impedance. The composite antenna disclosed in JP 11-68453 comprises plural nearly U-shaped folded antennas corresponding to plural frequency bands, Each U-shaped folded antenna includes a main element having one end as a feeding point and a sub-element folded from another end of the main element. The sub-element has an opened end. The main elements of the U-shaped folded antenna are integrated to reduce the external size of the composite antenna. In JP 11-68453, a low frequency band is 860 MHz band while a high frequency band is 1900 MHz band.

The antenna devices disclosed in JP 2002-185238 A and JP 11-68453A only cover the low frequency band between 800 MHz and 900 MHz and the high frequency band between 1.8 GHz and 2.0 GHz. Accordingly, the antenna devices disclosed in JP 2002-185238 A and JP 11-68453 A are disadvantageous in that it is impossible to cover the above-mentioned UWB band.

SUMMARY OF THE INVENTION

It is therefore an exemplary object of the present invention to provide a broadband antenna unit which is capable of covering not only a frequency band for UWB but also a frequency band for use in cellular telephone.

It is another exemplary object of the present invention to provide a broadband antenna unit having a low tall (height) which is capable of being included in a mobile equipment terminal.

Other objects of this invention will become clear as the description proceeds.

According to a first exemplary aspect of this invention, an antenna element comprises a folded plate-shaped monopole antenna portion having a U-shape in cross section, a first conductive element extending from a first location of the folded plate-shaped monopole antenna portion, and a second conductive element extending from a second location of the folded plate-shaped monopole antenna portion.

According to a second exemplary aspect of this invention, a broadband antenna unit comprises a ground plate, an antenna element disposed in the vicinity of an end of the ground plate, and a circuit board for mounting the antenna element thereon. The antenna element comprises a folded plate-shaped monopole antenna portion having a U-shape in cross section, a first conductive element extending from a first location of the folded plate-shaped monopole antenna portion, and a second conductive element extending from a second location of the folded plate-shaped monopole antenna portion.

DESCRIPTION OF THE PREFERRED EMBODIMENTS

Figure 1:
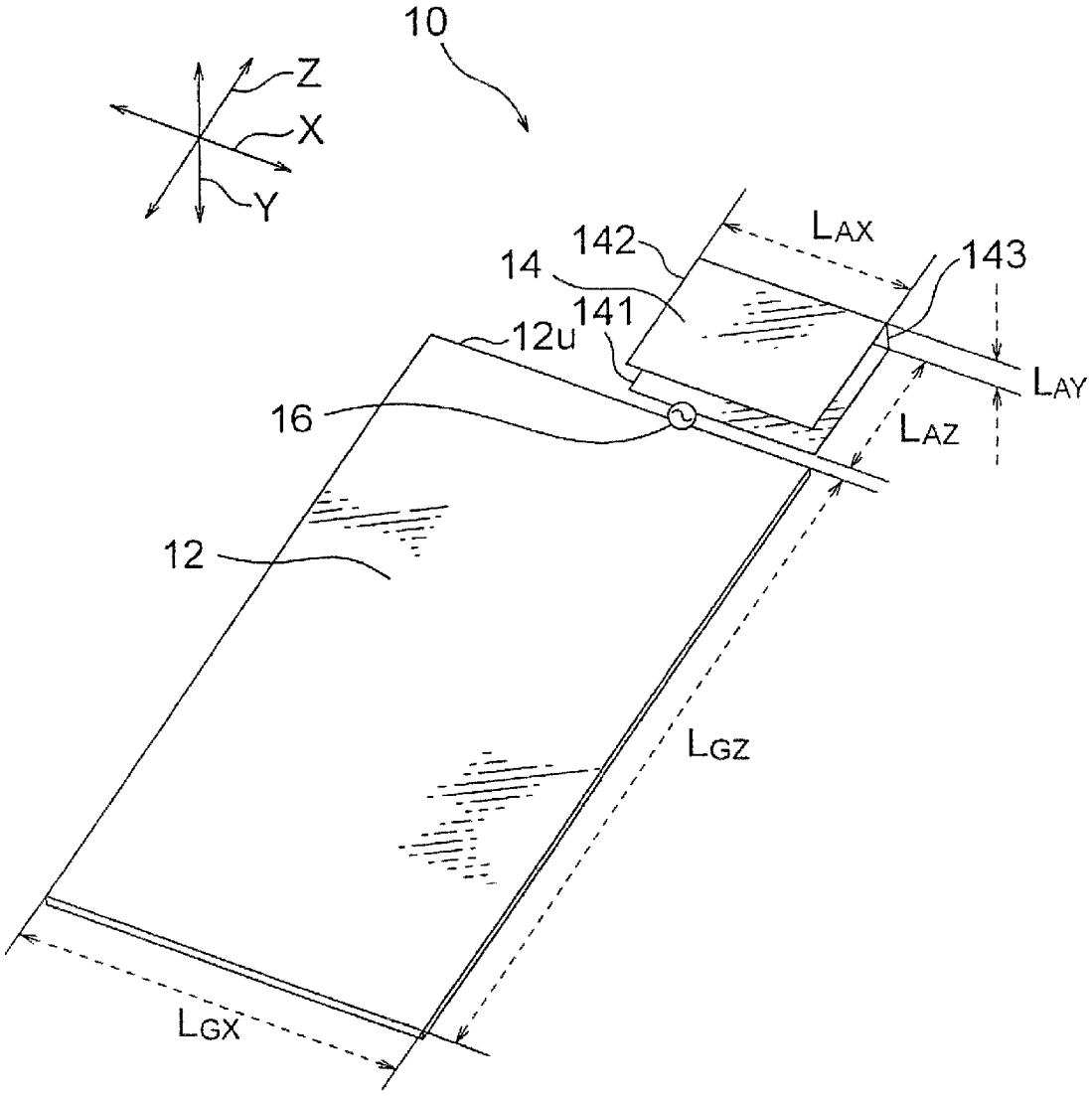
FIG. 1 RELATED ART
FIG. 1 is a schematic perspective view showing a first related art antenna unit.
Figure 2:
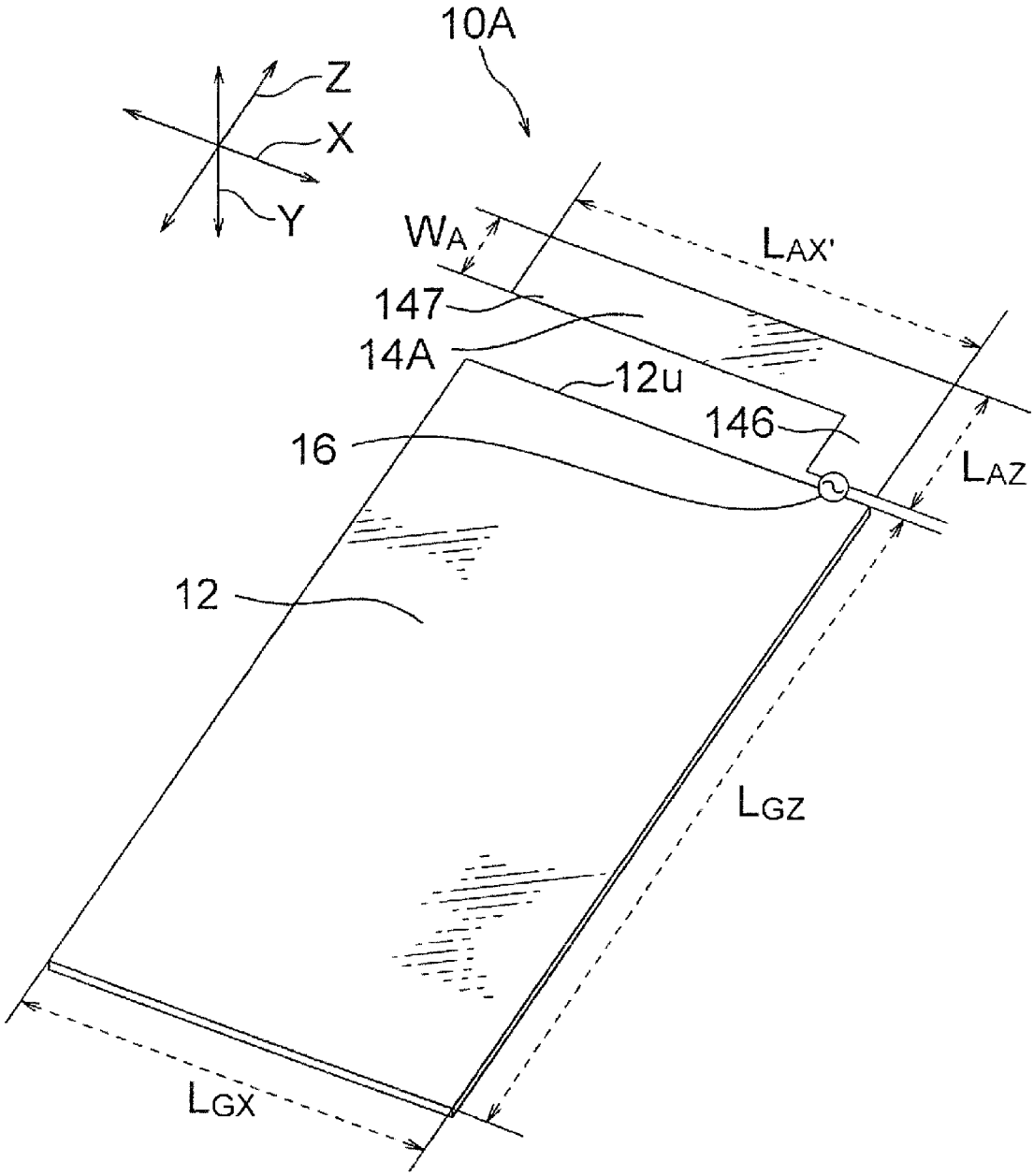
FIG. 2 RELATED ART
FIG. 2 is a schematic perspective view showing a second related art antenna unit.

Referring to FIGS. 1 and 2, first and second related art antenna units 10 and 10A will be described at first in order to facilitate an understanding of the present invention. FIG. 1 is a schematic perspective view showing the first related art antenna unit 10 while FIG. 2 is a schematic perspective view showing the second related art antenna unit 10A. In FIGS. 1 and 2, a left-and-right direction (a width direction, a horizontal direction) is represented by an X-axis direction, a fore-and-aft direction (a depth direction, a thickness direction) is represented by a Y-axis direction, and an up-and-down direction (a height direction, a vertical direction) is represented by a Z-axis direction.

The first related art antenna unit 10 illustrated in FIG. 1 comprises a folded plane-shaped monopole antenna (FPMA) while the second related art antenna unit 10A illustrated in FIG. 2 comprises an inverted-L antenna (ILA).

Referring now to FIG. 1, the description will proceed to the first related art antenna unit (the folded plane-shaped monopole antenna) 10. The first related art antenna unit 10 comprises a ground plate 12 and an antenna element 14.

The ground plate 12 has a rectangular shape which has an X-direction length (a width) of $L_{GX}$ and a Z-direction length (a height) of $L_{GZ}$. In the example being illustrated, the X-direction length (width) $L_{GX}$ is equal to 40 mm and the Z-direction length (height) $L_{GZ}$ is equal to 80 mm. That is, the ground plate 12 extends in parallel with a X-Z plane defined by the left-and-right direction (the horizontal direction) X and the up-and-down direction (the vertical direction) Z.

In the vicinity of an upper edge or end (an upper side) 12*u* of the ground plate 12, the antenna element 14 is disposed at a right and upper corner portion thereof. In other words, the antenna element 14 is disposed at the right and upper corner portion of the ground plate 12 with a predetermined gap (a feeding distance) apart from the ground plate 12. The antenna element 14 has a U-shape in cross section which has an X-direction length $L_{AX}$, a Z-direction length $L_{AZ}$, and a Y-direction length $L_{AY}$. That is, the antenna element 14 serves as a folded plate-shaped monopole antenna (FPMA) having the U-shape in cross section. In the example being illustrated, the X-direction length $L_{AX}$ is equal to 20 mm, the Z-direction length $L_{AZ}$ is equal to 15 mm, and the Y-direction length $L_{AY}$ is equal to 4 mm.

More specifically, the antenna element 14 comprises a first conductive plate 141 having a rectangular shape, a second conductive plate 142 having a rectangular shape, and a coupling plate 143. The first conductive plate 141 extends on a plane which is flush with the X-Z plate where the ground plate 12 extends. The second conductive plate 142 is disposed in parallel with the first conductive plate 141 with apart from the first conductive plate 141 by a thickness $L_{AY}$ of 4 mm in the thickness direction Y. The coupling plate 143 is for coupling the first conductive plate 141 with the second conductive plate 142 at an first end portion away from the ground plate 12. Each of the first conductive plate 141 and the second conductive plate 142 has the X-direction length $L_{AX}$ and the Z-direction length $L_{AZ}$. The first conductive plate 141, the second conductive plate 142, and the coupling plate 143 may be manufactured by a bend working of one metal plate.

As shown in FIG. 1, between the ground plate 12 and the antenna element 14, a feeding point 16 is disposed at a position apart from a right and upper corner of the ground plate 12 by a predetermined distance.

Referring now to FIG. 2, the description will proceed to the second related art antenna unit (the inverted-L antenna) 10A. The second related art antenna unit 10A is similar structure to the first related art antenna unit 10 illustrated in FIG. 1 except those points which will later be described. The antenna element is therefore depicted at 14A.

The antenna element 14A is disposed in the vicinity of the upper edge or end (the upper side) 12*u* of the ground plate 12. The antenna element 14A has an inverted-L shape having a width $W_A$ that extends on a plane which is flush with the X-Z plate where the ground plate 12 extends. That is, the antenna element 14A acts as the inverted-L antenna (ILA). More specifically, the antenna element 14A comprises a first metal plate 146 and a second metal plate 147. The first metal plate 146 extends in the height direction Z by a Z-direction length $L_{AZ}$ with a predetermined gap (a feeding distance) apart from the right and upper corner portion of the ground plate 12. The second metal plate 147 extends from the first metal plate 146 at an end side away from the ground plate 12 in the right-and-left direction X in parallel with the ground plate 12 by a X-direction length $L_{AX'}$. In the example being illustrated, the width $W_A$ is equal to 7 mm, the Z-direction length $L_{AZ}$ is equal to 15 mm, and the X-direction length $L_{AX'}$ is equal to 40 mm.

As shown in FIG. 2, between the ground plate 12 and the antenna element 14A, the feeding point 16 is disposed at a position apart from a right and upper corner of the ground plate 12 by a predetermined distance.

Figure 3:
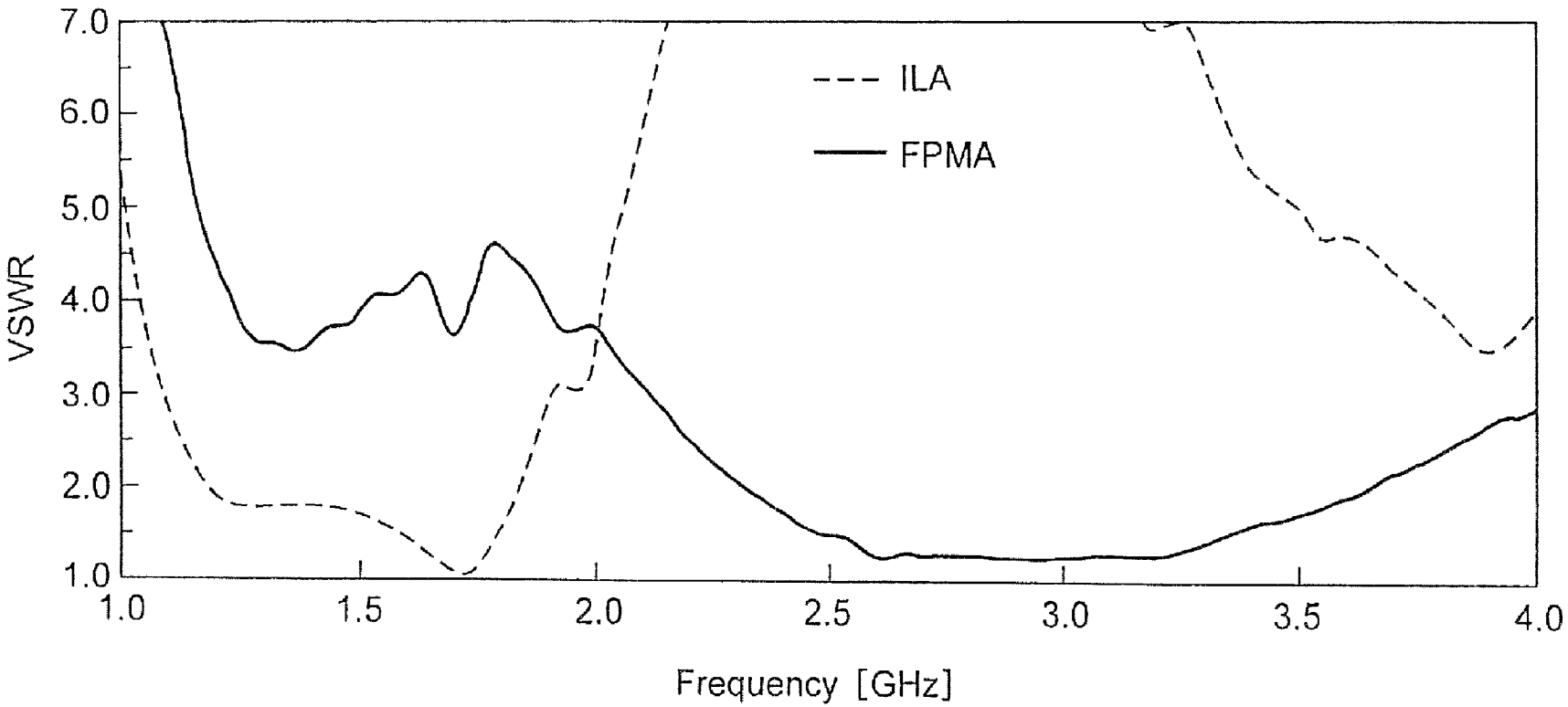
FIG. 3 RELATED ART
FIG. 3 is a view showing of frequency characteristics of VSWRs of the related art antenna units illustrated in FIGS. 1 and 2.

FIG. 3 shows frequency characteristics of voltage standing wave ratios (VSWRs) of the first related art antenna unit 10 illustrated in FIG. 1 and of the second related art antenna unit 10A illustrated in FIG. 2. The illustrated frequency characteristics of the VSWRs are analyzed by using the finite integral method. In FIG. 3, the abscissa represents a frequency [GHz] and the ordinate represents the VSWR. In FIG. 3, a solid line shows the frequency characteristic of the VSWR of the first related art antenna unit (FPMA) 10 while a broken line shows the frequency characteristic of the VSWR of the second related art antenna unit (ILA) 10A.

As seen in FIG. 3, it is understood that the first related art antenna unit (FPMA) 10 illustrated in FIG. 1 has the VSWR of 3 or less in a frequency range which is not less than 2.2 GHz and has the VSWR of 3 or more in a frequency range which is not more than 2.2 GHz. On the other hand, it is understood that the second related art antenna unit (ILA) 10A illustrated in FIG. 2 has the VSWR of 3 or less in a predetermined frequency range between about 1.1 GHz and about 1.9 GHz has the VSWR of 3 or more in a frequency range except for the predetermined frequency range.

From the above-mention, it is understood that the folded plate-shaped monopole antenna (FPMA) is available at a relatively higher frequency range while the inverted-L antenna (ILA) is available at a relatively lower frequency range.

The present inventor thinks that the frequency characteristic of a small VSWR in a wider frequency range may be obtained if the folded plate-shaped monopole antenna (FPMA) and the inverted-L antenna (ILA) are systematically coupled to take advantage of the respective antennas and, arrived at this invention ultimately. In addition, in the manner which will later become clear as the description proceeds, the present inventor verified that a feeding point must be set at an optimum position in order to obtain the frequency characteristic of a good VSWR.

There are mobile (cellular) telephones as a type of mobile equipment terminals. There are various types in the mobile telephone sets which are broadly divided into a straight type and a foldable type. The foldable type mobile telephone set comprises a lower unit having a console portion such as ten keys, an upper unit having a display portion, and a hinge portion for joining the lower unit to the upper unit for opening and closing. Inasmuch as the console portion and the display portion are mounted on different units in the foldable type mobile telephone set, the foldable type mobile telephone set has a relatively large size when it is put into an open state. On the other hand, the straight type mobile telephone set comprises a unit body on which a console portion and a display portion are mounted. As a result, the straight type mobile telephone set has a size which is about half that of the foldable type mobile telephone set which is put into the open state.

Figure 4:
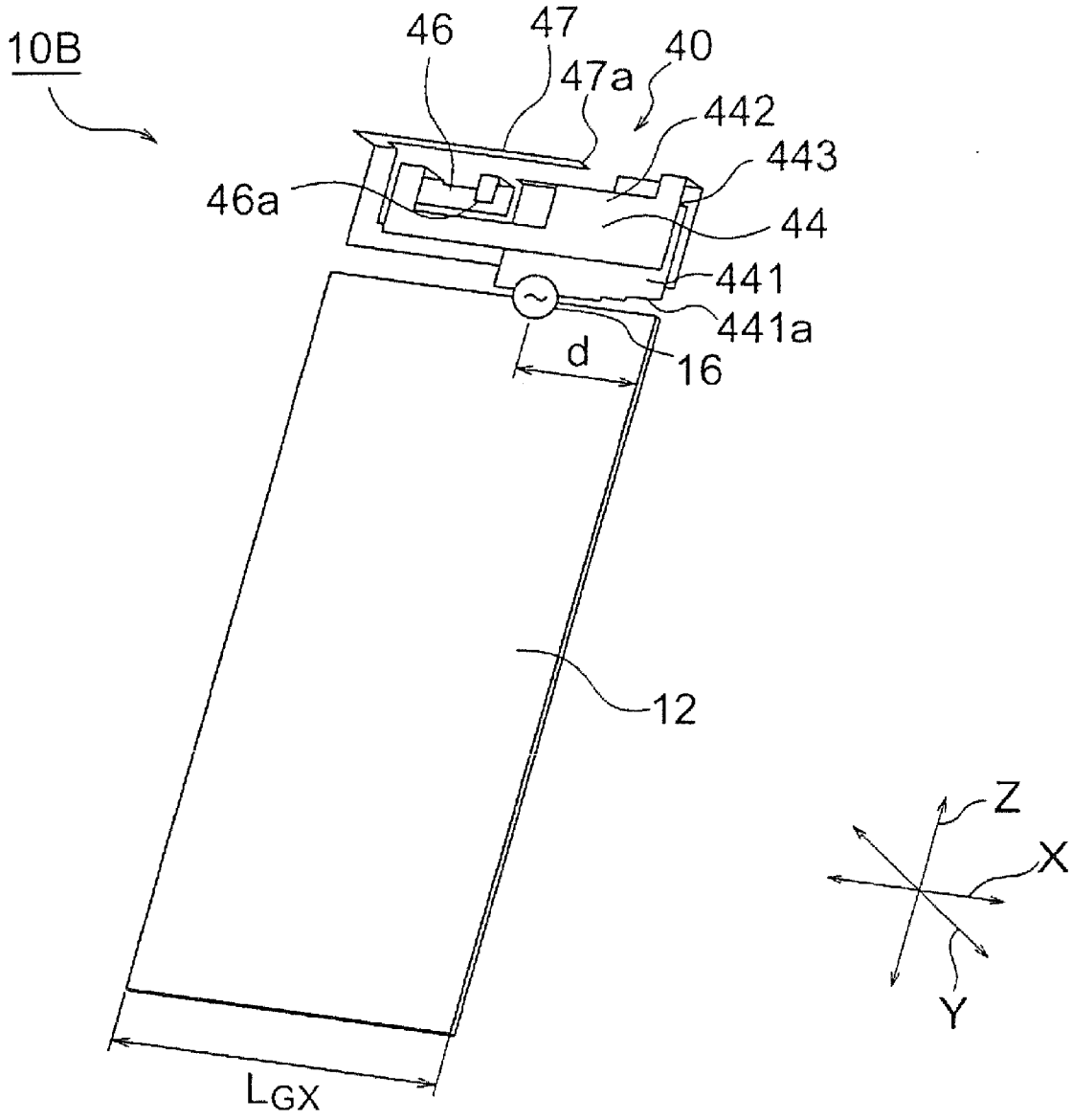
FIG. 4 is a schematic perspective view showing an ultra wideband antenna unit according to a first exemplary embodiment of this invention.

Referring to FIGS. 4 through 8, the description will proceed to an ultra wideband antenna unit 10B according to a first exemplary embodiment of this invention. The illustrated ultra wideband antenna unit 10B is an antenna unit which can be included in, for example, the straight type mobile telephone set. The illustrated ultra wideband antenna unit 10B is similar in structure to the first related art antenna unit 10 illustrated in FIG. 1 except those points which will later become clear. The antenna element is therefore depicted at 40. Accordingly, similar reference symbols are attached to those having functions similar to those illustrated in FIG. 1 and the description thereof is omitted for the sake of simplification of the description. FIG. 4 is a schematic perspective view of the ultra wideband antenna unit 10B.

Figure 5:
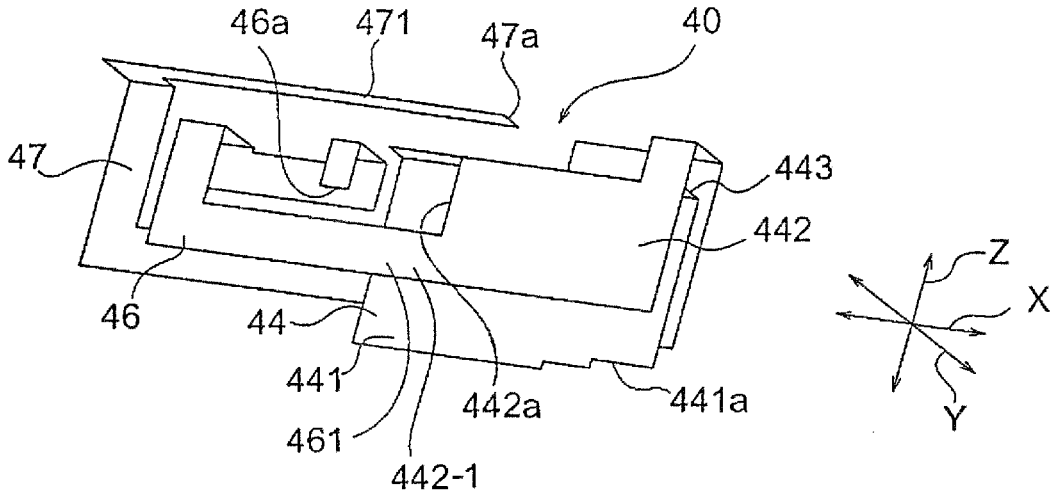
FIG. 5 is an expanded perspective view showing only an antenna element for use in the ultra wideband antenna unit illustrated in FIG. 4.
Figure 6:
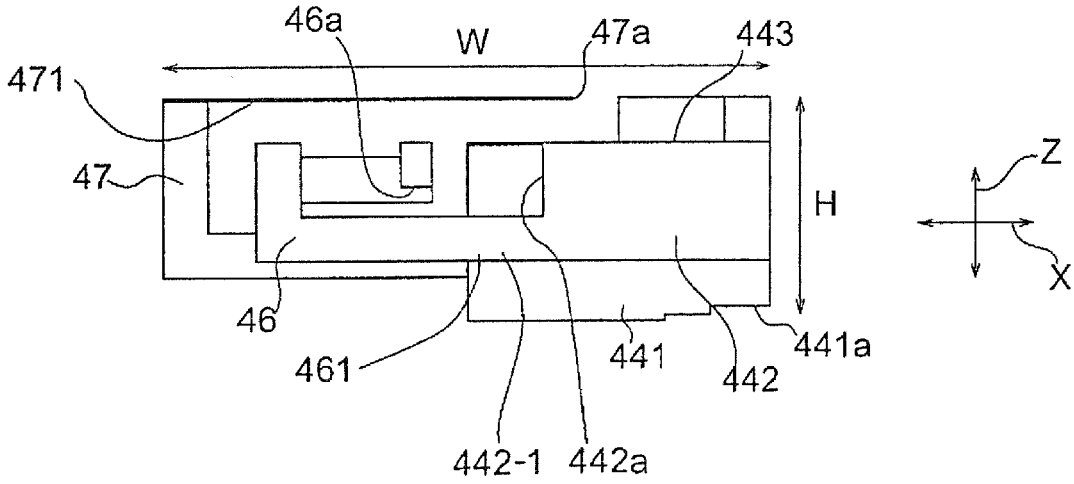
FIG. 6 is a front view of the antenna element illustrated in FIG. 5.
Figure 7:
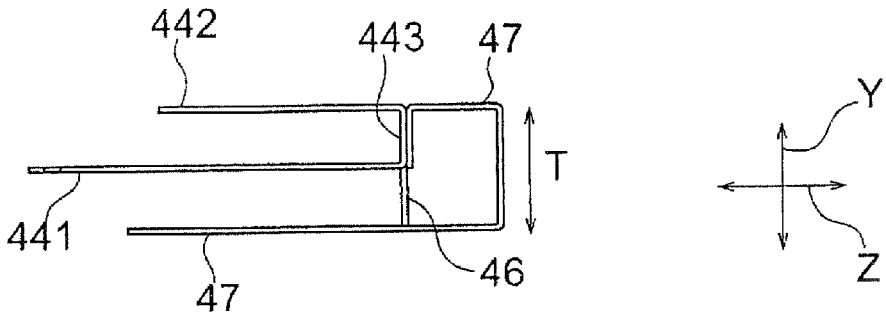
FIG. 7 is a right-hand side view of the antenna element illustrated in FIG. 5.
Figure 8:
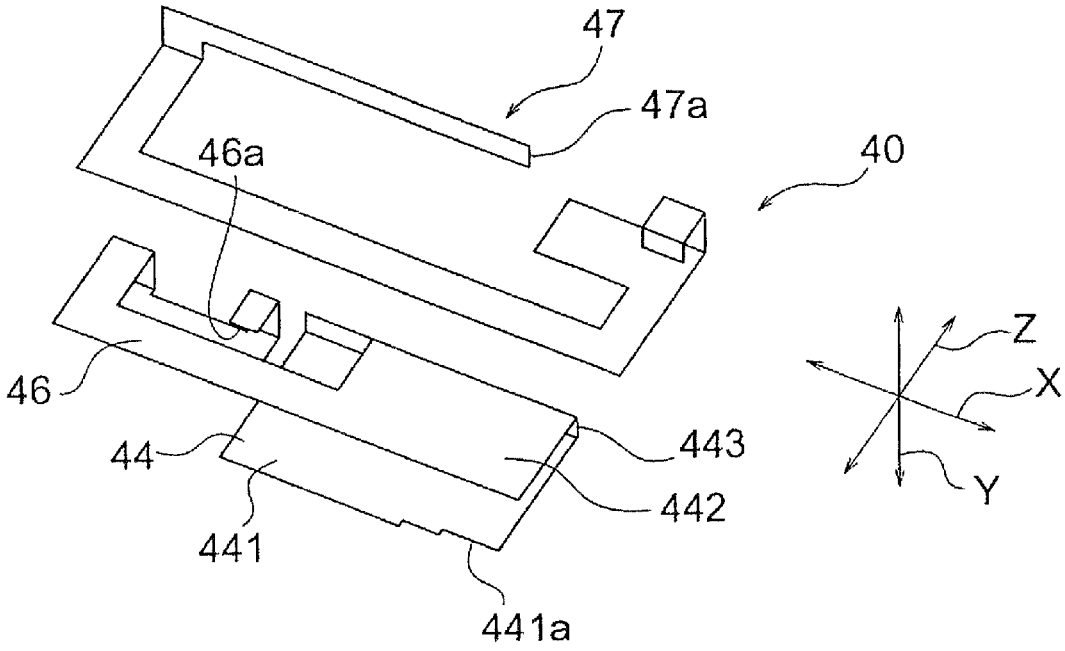
FIG. 8 is an exploded perspective view of the antenna element illustrated in FIG. 5.

FIG. 5 is an expanded perspective view showing only the antenna element 40. FIG. 6 is a front view of the antenna element 40 and FIG. 7 is a right-hand side view of the antenna element 40. FIG. 8 is an exploded perspective view of the antenna element 40. Although illustration is not made in FIG. 4, the antenna element 40 is mounted on a printed circuit board of the straight type mobile telephone set or the like.

The illustrated antenna element 40 comprises a folded plate-shaped monopole antenna portion 44 having a U-shape in cross section, a first conductive element 46 extending from a first location of the folded plate-shaped monopole antenna portion 44, and a second conductive element 47 extending from a second location of the folded plate-shaped monopole antenna portion 44. In addition, the folded plate-shaped monopole antenna portion 44 is also called a plate-shaped antenna.

The illustrated folded plate-shaped monopole antenna portion 44 comprises a first conductive plate 441 having a first length in the Z-axis direction and a first width in the X-axis direction, a second conductive plate 442 disposed in parallel with the first conductive plate 441, and a coupling plate 443 for coupling the first conductive plate 441 with the second conductive plate 442 at a first end portion (an end side) away from the ground plate 12. As shown in FIG. 5, the second conductive plate 442 has a second length in the Z-axis direction that is shorter than the first length. In the example being illustrated, the first length is equal to 13 mm. In addition, the second conductive plate 442 has a second width in the X-axis direction that is shorter than the first width. In the example being illustrated, the first width is equal to 20 mm.

As shown in FIG. 5, the first conductive element 46 extends from the second conductive plate 442 as the first location while the second conductive element 47 extends from the coupling plate 443 as the second location.

In the example being illustrated, the first conductive plate 441 has a notch 441*a* at a right side of a tip portion thereof (an end portion opposite to the ground plate 12). In this exemplary embodiment, a right side of the folded plate-shaped monopole antenna portion 44 is called a first side edge while a left side thereof is called a second side edge. Accordingly, the notch 441*a* is formed at the tip portion of the first conductive plate 441 in the first side edge side.

The reason that the notch 441*a* is formed in the first conductive plate 441 is for improving a frequency characteristic of the folded plate-shaped monopole antenna portion 44 by itself.

As is apparent from FIGS. 5 to 7, in the antenna element 40, the first conductive element 46 and the second conductive element 47 are bent in a three-dimensional fashion so that the antenna element 40 is contained in a space defined by an imaginary rectangular parallelepiped having a predetermined width W in the X-axis direction, a predetermined thickness T in the Y-axis direction, and a predetermined height H in the Z-axis direction. In the example being illustrated, the predetermined width W is equal to 40.0 mm, the predetermined thickness T is equal to 4.0 mm, and the predetermined height H is equal to 15.0 mm. Accordingly, the predetermined width W is equal to the width $L_{GX}$ of the ground plate 12.

As shown in FIG. 4, the first conductive plate 441 has a feeding point (feeding portion) 16 at a predetermined position of a tip portion thereof. The second conductive element 47 has a tip 47*a* which is located so as to be apart from the feeding point 16 by the utmost distance in the height direction Z of the above-mentioned imaginary rectangular parallelepiped.

In other words, as shown in FIGS. 5 and 6, the second conductive element 47 comprises a tip-side extending portion 471 including the tip 47*a* that is disposed in an upper side of the first conductive element 46 and the folded plate-shaped monopole antenna portion 44 in view of the ground plate 12. With this structure, it is possible to receive the GSM band. That is, it is possible to improve a gain the GSM band in the antenna element 40.

In addition, the second conductive plate 442 of the folded plate-shaped monopole antenna portion 44 has a notch 442*a* which is formed therein. In other words, the second conductive plate 442 has a portion 442-1 remaining by the notch 442*a* that is used as a part 461 of the first conductive element 46. With this structure, it is possible to shrink the antenna element 40.

In the illustrated antenna element 40, the folded plate-shaped monopole antenna portion 44 covers a first frequency band (higher frequencies), the second conductive element 47 covers a second frequency band (lower frequencies) lower than the first frequency band, and a combination of the first conductive element 46 and the second conductive element 47 covers a third frequency band (middle frequencies) which lies between the first frequency band and the second frequency band. More specifically, the first frequency band contains the UWB band, the second band contains the GSM band, and the third frequency band contains the DSM band, the PCS band, and the UMTS band.

At any rate, a frequency band for use in cellular telephone is covered by the first and the second conductive elements 46 and 47 and a frequency band for UWB is covered by the folded plate-shaped monopole antenna portion 44. That is, the illustrated antenna element 40 has an antenna characteristic having three bands of the higher frequencies, the middle frequencies, and the lower frequencies, in the manner which will later be described.

In order to cover such frequency bands, the illustrated antenna element 40 has a length from the feeding point (the feeding portion) 16 to the tip 47*a* of the second conductive element 47 that is equal to 0.27 times wavelength of the GSM band and a length from the feeding point (the feeding portion) 16 to a tip 46*a* of the first conductive element 46 that is equal to 0.33 times wavelength of the DCS band. In addition, the antenna element 40 has an optimized shape in view of mounting to the ground plate (the printed circuit board) 12 of the straight type mobile telephone set.

As shown in FIG. 4, disposed between the ground plate (the printed circuit board) 12 and the antenna element 40, the feeding point 16 is located at a feeding position which is apart from the right and upper corner (the right-hand side edge) of the ground plate 12 by a predetermined distance d. Herein, the predetermined distance d is also called the feeding position. In the example being illustrated, the feeding position d is equal to 16 mm. Accordingly, a ratio between the width of the ground plate 12 and the feeding position (the predetermined distance) d is substantially 5:2 when a ratio between the width $L_{GX}$ of the ground plate 12 and a width of the first conductive plate 441 of the antenna element 40 is 2:1.

Figure 9:
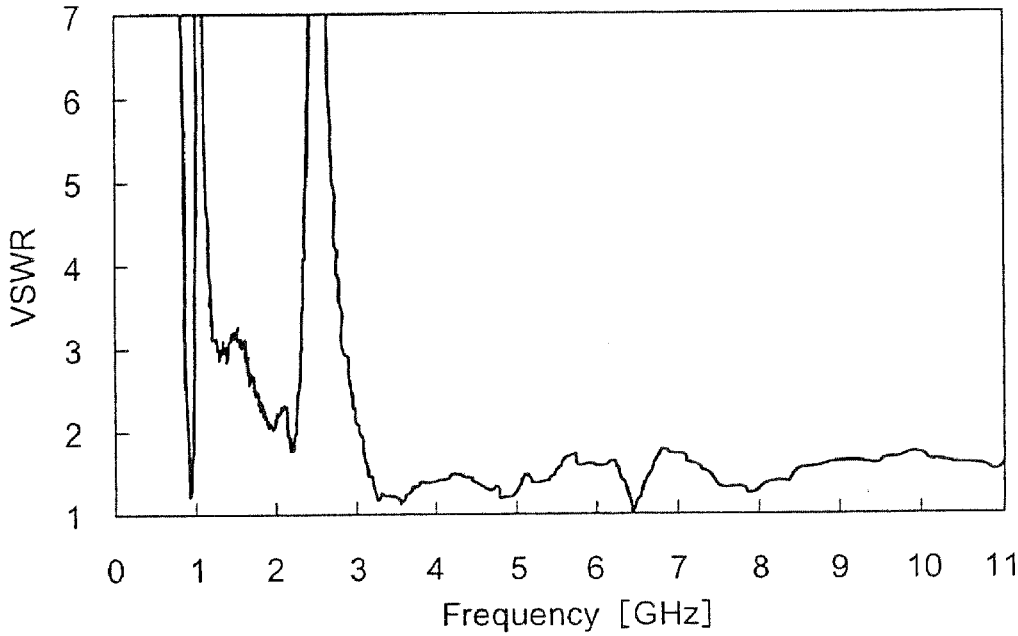
FIG. 9 is a view showing a frequency characteristic of VSWR of the ultra wideband antenna unit illustrated in FIG. 4.

FIG. 9 shows a frequency characteristic of a VSWR of the ultra wideband antenna unit 10B illustrated in FIG. 4. In FIG. 9, the abscissa represents a frequency [GHz] and the ordinate represents the VSWR.

Figure 10:
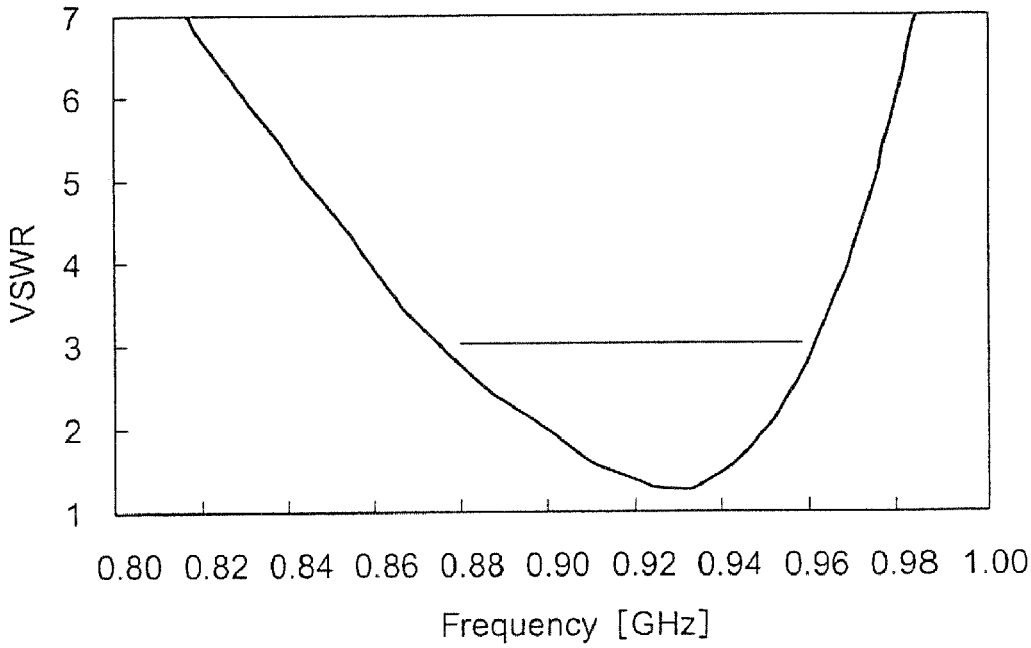
FIG. 10 is a view showing a frequency characteristic of the VSWR of the ultra wideband antenna unit with lower frequencies (0.80 GHz to 1.00 GHz) in FIG. 9 enlarged.
Figure 11:
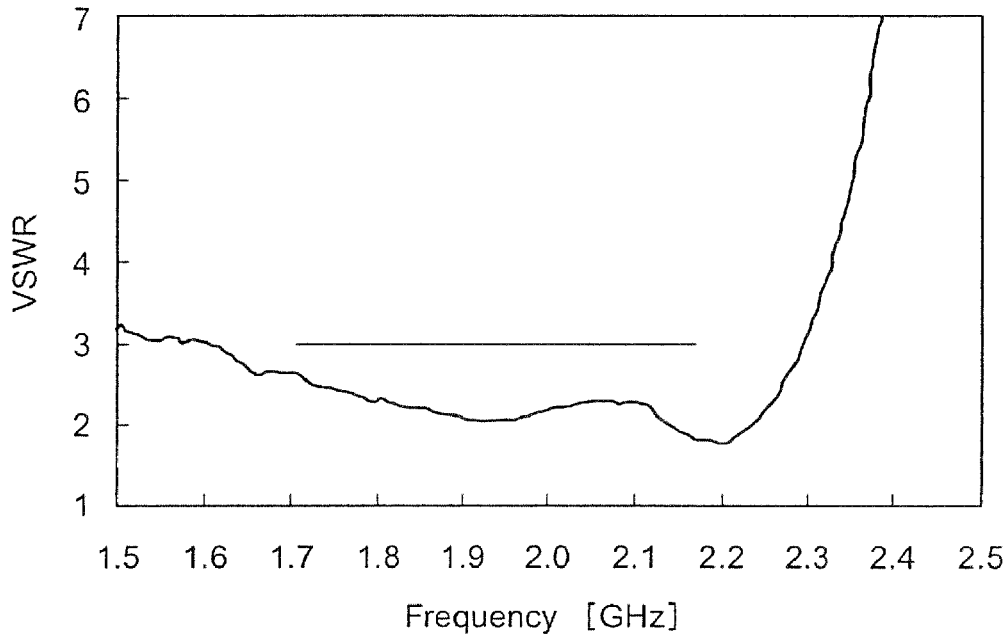
FIG. 11 is a view showing a frequency characteristic of the VSWR of the ultra wideband antenna unit with middle frequencies (1.5 GHz to 2.5 GHz) in FIG. 9 enlarged.
Figure 12:
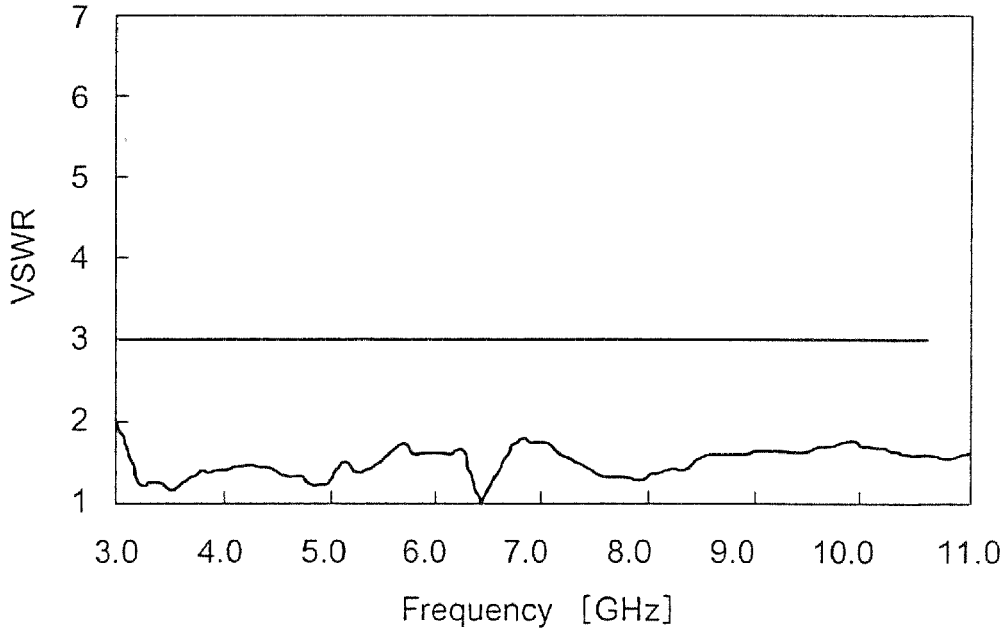
FIG. 12 is a view showing a frequency characteristic of the VSWR of the ultra wideband antenna unit with higher frequencies (3.0 GHz to 11.0 GHz) in FIG. 9 enlarged.

FIG. 10 shows a frequency characteristic of the VSWR of the ultra wideband antenna unit 10B with the lower frequencies (0.80 GHz to 1.00 GHz) in FIG. 9 enlarged. In other words, FIG. 10 shows the frequency characteristic of the VSWR in the GSM band. FIG. 11 shows a frequency characteristic of the VSWR of the ultra wideband antenna unit 10B with the middle frequencies (1.5 GHz to 2.5 GHz) in FIG. 9 enlarged. In other words, FIG. 11 shows the frequency characteristic of the VSWR in the DCS band, in the PCS band, and in the UMTS band. FIG. 12 shows a frequency characteristic of the VSWR of the ultra wideband antenna unit 10B with the higher frequencies (3.0 GHz to 11.0 GHz) in FIG. 9 enlarged. In other words, FIG. 12 shows the frequency characteristic of the VSWR of the ultra wideband antenna unit 10B in the UWB band.

As apparent from FIG. 10, it is understood that the VSWR is 3 or less in the GSM band of a frequency range between 890 MHz and 960 MHz. This is because the fundamental of the second conductive element 47 covers the second frequency band (the lower frequencies) containing the GSM band.

In addition, as apparent from FIG. 11, it is understood that the VSWR is 3 or less in the DCS band (1710 MHz to 1880 MHz), in the PCS band (1850 MHz to 1990 MHz), and in the UMTS band (1920 MHz to 2170 MHz) of a frequency range between 1710 MHz and 2170 MHz. This is because the fundamental of the first conductive element 46 and the second harmonic of the second conductive element 47 cover the third frequency band (the middle frequencies) containing the DCS band, the PCS band, and the UMTS band.

Furthermore, as apparent from FIG. 12, it is understood that the VSWR is 3 or less in the UWB band of a frequency range between 3.1 GHz and 10.6 GHz. This is because the folded plate-shaped monopole antenna portion 44 covers the first frequency band (the higher frequencies) containing the UWB band.

At any rate, it is understood that the ultra wideband antenna unit 10B covers a frequency band for use in cellular telephone and a frequency band for UWB.

Figure 13:
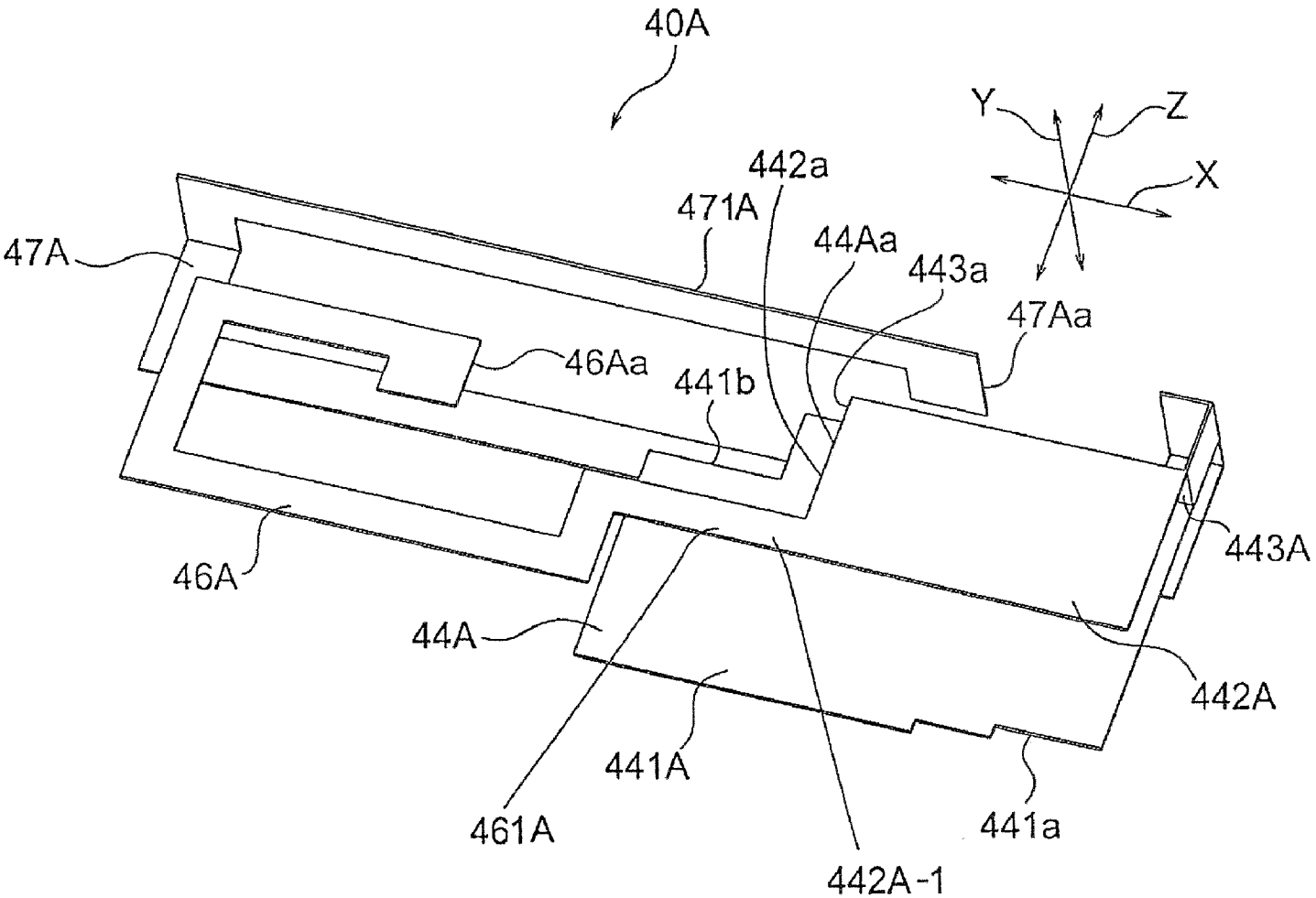
FIG. 13 is a perspective view of an antenna element according to a second exemplary embodiment of this invention.
Figure 14:
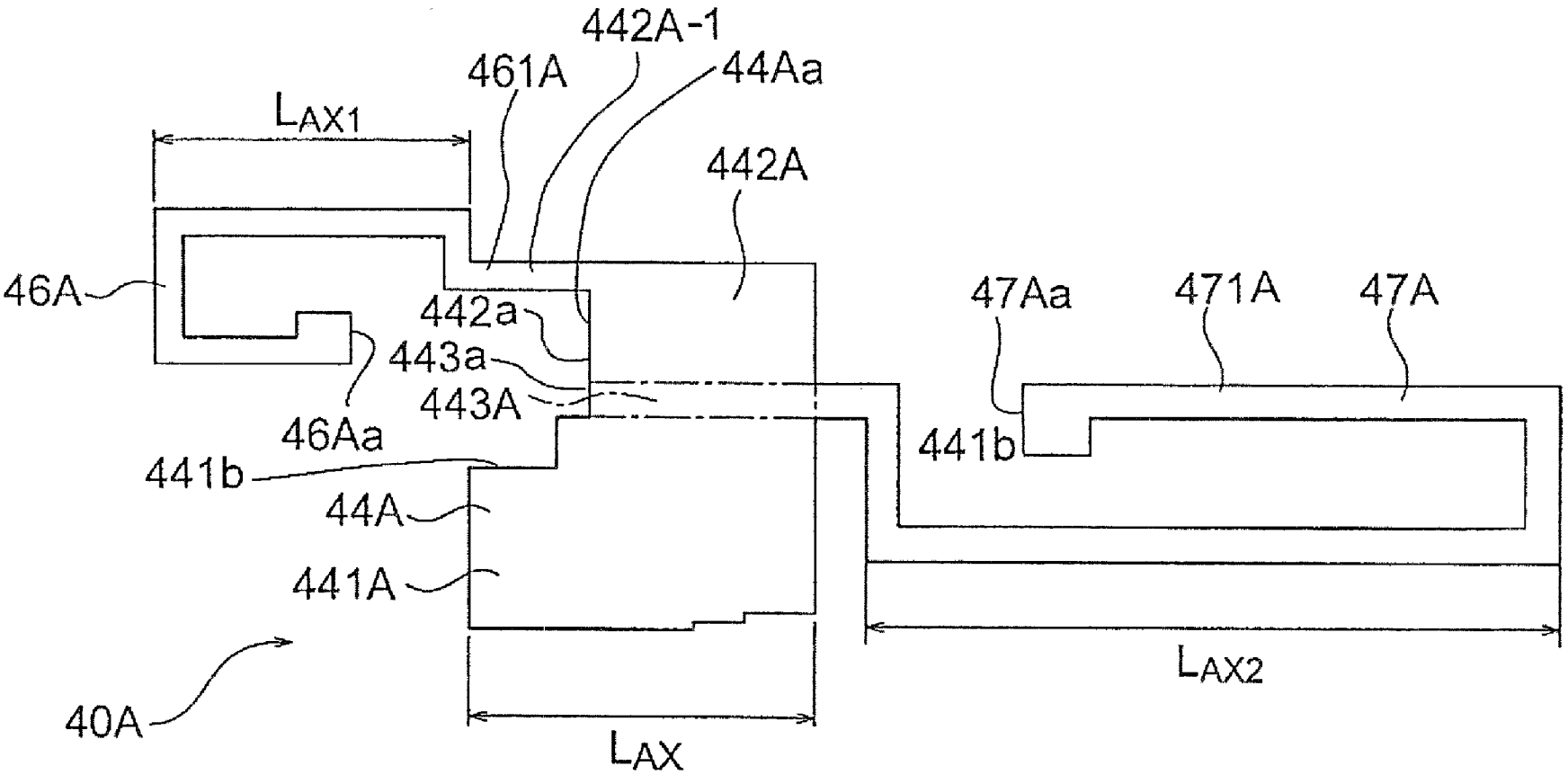
FIG. 14 is a developed view of the antenna element illustrated in FIG. 13.

Referring to FIGS. 13 and 14, the description will proceed to an antenna element 40A according to a second exemplary embodiment of this invention. FIG. 13 is a perspective view of the antenna element 40A and FIG. 14 is a developed view of the antenna element 40A.

The illustrated antenna element 40A can be manufactured by stamping and bending a sheet metal.

The illustrated antenna element 40A comprises a folded plate-shaped monopole antenna portion 44A having a U-shape in cross section, a first conductive element 46A extending from a first location of the folded plate-shaped monopole antenna portion 44A, and a second conductive element 47A extending from a second location of the folded plate-shaped monopole antenna portion 44A. The folded plate-shaped monopole antenna portion 44A is also called a plate-shaped antenna.

The illustrated folded plate-shaped monopole antenna portion 44A comprises a first conductive plate 441A having a first length in the Z-axis direction and a first width $L_{AX}$ in the X-axis direction, a second conductive plate 442A disposed in parallel with the first conductive plate 441A, and a coupling plate 443A for coupling the first conductive plate 441A with the second conductive plate 442A at a first end portion (an end side) away from the ground plate 12 (FIG. 4). As shown in FIG. 13, the second conductive plate 442A has a second length in the Z-axis direction that is shorter than the first length. In the example being illustrated, the first length is equal to 13 mm. In addition, the second conductive plate 442A has a second width in the X-axis direction that is shorter than the first width $L_{AX}$. In the example being illustrated, the first width $L_{AX}$ is equal to 20 mm.

As shown in FIG. 13, the first conductive element 46A extends from the second conductive plate 442A as the first location while the second conductive element 47A extends from the coupling plate 443A as the second location.

In the example being illustrated, the first conductive plate 441A has a notch 441*a* at a right side of a tip portion thereof (an end portion opposite to the ground plate 12 (FIG. 4)). In this exemplary embodiment, a right side of the folded plate-shaped monopole antenna portion 44A is called a first side edge while a left side thereof is called a second side edge. Accordingly, the notch 441*a* is formed at the tip portion of the first conductive plate 441A in the first side edge side.

The reason that the notch 441*a* is formed in the first conductive plate 441A is for improving a frequency characteristic of the folded plate-shaped monopole antenna portion 44A by itself.

The illustrated conductive plate 441A has also another notch 441*b* at a left side of a rear portion thereof. In addition, the second conductive plate 442A and the coupling plate 443A have notches 442*a* and 443*a*, respectively, which are formed therein. That is, the folded plate-shaped monopole antenna portion 44A has a notch 44Aa consisting of the notches 441*b*, 442*a*, and 443*a*. In other words, the second conductive plate 442A has a portion 442A-1 remaining by the notch 44Aa that is used as a part 461A of the first conductive element 46A. With this structure, it is possible to shrink the antenna element 40A.

As is apparent from FIG. 13, in the antenna element 40A, the first conductive element 46A is bent in a two-dimensional fashion and the second conductive element 47A is bent in a three-dimensional fashion so that the antenna element 40A is contained in a space defined by an imaginary rectangular parallelepiped having a predetermined width in the X-axis direction, a predetermined thickness in the Y-axis direction, and a predetermined height in the Z-axis direction. In the example being illustrated, the predetermined width is equal to 40.0 mm, the predetermined thickness is equal to 4.0 mm, and the predetermined height is equal to 15.0 mm. Accordingly, the predetermined width is equal to the width $L_{GX}$ of the ground plate 12.

In the illustrated antenna element 40A, the first conductive element 46A extends in the two-dimensional fashion on a plane in which the second conductive plate 442A of the folded plate-shaped monopole antenna portion 44A extends. Relative to a left edge of the first conductive plate 441A of the folded plate-shaped monopole antenna portion 44A, the first conductive element 46A has a width $L_{AX1}$ in the X-axis direction that is equal to 18 mm. On the other hand, the second conductive element 47A has a width $L_{AX2}$ in the X-axis direction which is equal to the width $L_{GX}$ of the ground plate (FIG. 4), namely, 40 mm.

Although the illustration is not made in FIG. 13, the first conductive plate 441A has a feeding point (feeding portion) at a predetermined position of a tip portion thereof in the manner which is shown in FIG. 4. The second conductive element 47A has a tip 47Aa which is located so as to be apart from the feeding point by the utmost distance in the height direction Z of the above-mentioned imaginary rectangular parallelepiped.

In other words, as shown in FIG. 13, the second conductive element 47A comprises a tip-side extending portion 471A including the tip 47Aa that is disposed in an upper side of the first conductive element 46A and the folded plate-shaped monopole antenna portion 44A in view of the ground plate 12 (see, FIG. 4). With this structure, it is possible to receive the GSM band. That is, it is possible to improve a gain the GSM band in the antenna element 40A.

In the illustrated antenna element 40A, the folded plate-shaped monopole antenna portion 44A covers a first frequency band (higher frequencies), the second conductive element 47A covers a second frequency band (lower frequencies) lower than the first frequency band, and a combination of the first conductive element 46A and the second conductive element 47A covers a third frequency band (middle frequencies) which lies between the first frequency band and the second frequency band. More specifically, the first frequency band contains the UWB band, the second band contains the GSM band, and the third frequency band contains the DSM band, the PCS band, and the UMTS band.

At any rate, a frequency band for use in cellular telephone is covered by the first and the second conductive elements 46A and 47A and a frequency band for UWB is covered by the folded plate-shaped monopole antenna portion 44A. That is, the illustrated antenna element 40A has an antenna characteristic having three bands of the higher frequencies, the middle frequencies, and the lower frequencies, in a similar manner of the antenna element 40 illustrated in FIG. 5.

In order to cover such frequency bands, the illustrated antenna element 40A has a length from the feeding point (the feeding portion) 16 (FIG. 4) to the tip 47Aa of the second conductive element 47A that is equal to 0.27 times wavelength of the GSM band and a length from the feeding point (the feeding portion) 16 (FIG. 4) to a tip 46Aa of the first conductive element 46A that is equal to 0.33 times wavelength of the DCS band. In addition, the antenna element 40A has an optimized shape in view of mounting to the ground plate (the printed circuit board) 12 (FIG. 4) of the straight type mobile telephone set or the like.

The present inventor constructed the ultra wideband antenna unit by disposing the antenna element 40A illustrated in FIG. 13 in vicinity of the ground plate 12 so as to be embedded in the straight type mobile telephone set, in the manner which is shown in FIG. 4. The present inventor confirmed that such a constructed ultra wideband antenna unit covers a frequency band for use in cellular telephone and a frequency band for UWB, in the similar manner as a case illustrated in FIG. 9.

In the afore-mentioned broadband antenna unit according to the second aspect of this invention, the antenna element may be disposed on a side of one side edge side of the ground plate. In this event, the broadband antenna unit may have a feeding point between the ground plate and the antenna element that is located at a feeding position apart from the one side edge by a predetermined distance. When a ratio between the width of the ground plate and a width of the folded plate-shaped monopole antenna portion is 2:1, a ratio between a width of the ground plate and the predetermined distance preferably may be substantially 5:2.

In each of the afore-mentioned antenna element according to the first aspect of this invention and the afore-mentioned broadband antenna unit according to the second aspect of this invention, the folded plate-shaped monopole antenna portion may comprise a first conductive plate having a first length, a second conductive plate which is disposed in parallel with the first conductive plate and which has a second length shorter than the first length, and a coupling plate for coupling the first conductive plate with the second conductive plate at a first end portion thereof. In this event, the first conductive element may extend from the second conductive plate as the first location, and the second conductive element may extend from the coupling plate as the second location. The folded plate-shaped monopole antenna portion may have first and second side edges opposite to each other. Under the circumstances, the first conductive plate preferably may have a notch at a tip portion thereof in the first side edge side.

In addition, in each of the afore-mentioned antenna element according to the first aspect of this invention and the afore-mentioned broadband antenna unit according to the second aspect of this invention, the first conductive element and the second conductive element desirably may be bent so that the antenna element is contained in a space defined by an imaginary rectangular parallelepiped having a predetermined width, a predetermined thickness, and a predetermined height. The first conductive element may have a feeding point at a predetermined position of a tip portion thereof. In this event, the second conductive element preferably may have a tip which is located so as to be apart from the feeding point by the utmost distance in a height direction of the imaginary rectangular parallelepiped. The folded plate-shaped monopole antenna portion may cover a first frequency band, the second conductive element may cover a second frequency band lower than the first frequency band, and a combination of the first conductive element and the second conductive element may cover a third frequency band lying between the first frequency band and the second frequency band. Under the circumstances, the first frequency band may contain a UWB (Ultra Wide Band) band, the second frequency band may contain a GSM (Global System for Mobile communications) band, and the third frequency band may contain a DCS (Digital Communication System) band, a PCS (Personal Communication Services) band, and an UMTS (Universal Mobile Telecommunications System) band.

While this invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims. For example, the plate-shaped antenna 44 and 44A may not have a rectangular shape. Specifically, the plate-shaped antenna may be a wideband plate-shape monopole antenna which has a circular shape, a ring shape, a home base shape, a fan shape, or the like. In addition, each of the first and the second conductive elements may have a meandering shape. The antenna element may have round shape edges. The antenna element 40 and 40A may be mounted (embedded) in the foldable type mobile telephone set. Furthermore, the antenna element 40 and 40A may be mounted on the personal digital assistant (PDA).

What is claimed is:

1. An antenna element comprising:

a folded plate-shaped monopole antenna portion having a U-shape in cross section;

a first conductive element extending from a first location of said folded plate-shaped monopole antenna portion; and a second conductive element extending from a second location of said folded plate-shaped monopole antenna portion;

wherein said folded plate-shaped monopole antenna portion comprises:

a first conductive plate having a first length;

a second conductive plate which is disposed in parallel with said first conductive plate and which has a second length shorter than the first length; and a coupling plate which couples said first conductive plate with said second conductive plate at a first end portion thereof;

wherein said first conductive element extends from said second conductive plate as the first location;

wherein said second conductive element extends from said coupling plate as the second location;

wherein said first conductive element and said second conductive element are bent so that said antenna element is contained in a space defined by an imaginary rectangular parallelepiped having a predetermined width, a predetermined thickness, and a predetermined height;

wherein said first conductive element has a feeding point at a predetermined position of a tip portion thereof;

wherein said second conductive element has a tip which is located so as to be apart from the feeding point by an utmost distance in a height direction of the imaginary rectangular parallelepiped.

2. The antenna element as claimed in claim 1, wherein said folded plate-shaped monopole antenna portion has first and second side edges opposite to each other, and wherein said first conductive plate has a notch at a tip portion thereof in the first side edge side.

3. An antenna element comprising:

a folded plate-shaped monopole antenna portion having a U-shape in cross section;

a first conductive element extending from a first location of said folded plate-shaped monopole antenna portion; and a second conductive element extending from a second location of said folded plate-shaped monopole antenna portion;

wherein said folded plate-shaped monopole antenna portion covers a first frequency band, said second conductive element covers a second frequency band lower than the first frequency band, and a combination of said first conductive element and said second conductive element covers a third frequency band lying between the first frequency band and the second frequency band.

4. The antenna element as claimed in claim 3, wherein the first frequency band contains a UWB (Ultra Wide Band) band, the second frequency band contains a GSM (Global System for Mobile communications) band, and the third frequency band contains a DCS (Digital Communication System) band, a PCS (Personal Communication Services) band, and an UMTS (Universal Mobile Telecommunications System) band.

5. A broadband antenna unit comprising:

a ground plate;

an antenna element disposed in the vicinity of an end of said ground plate; and a circuit board for mounting said antenna element thereon;

wherein said antenna element comprises:

a folded plate-shaped monopole antenna portion having a U-shape in cross section;

a first conductive element extending from a first location of said folded plate-shaped monopole antenna portion; and a second conductive element extending from a second location of said folded plate-shaped monopole antenna portion;

wherein said folded plate-shaped monopole antenna portion comprises:

a first conductive plate having a first length;

a second conductive plate which is disposed in parallel with said first conductive plate and which has a second length shorter than the first length; and a coupling plate which couples said first conductive plate with said second conductive plate at a first end portion away from said ground plate;

wherein said first conductive element extends from said second conductive plate as the first location;

wherein said second conductive element extends from said coupling plate as the second location;

wherein said first conductive element and said second conductive element are bent so that said antenna element is contained in a space defined by an imaginary rectangular parallelepiped having a predetermined width, a predetermined thickness, and a predetermined height;

wherein said first conductive element has a feeding point at a predetermined position of a tip portion thereof; and wherein said second conductive element has a tip which is located so as to be apart from the feeding point by an utmost distance in a height direction of the imaginary rectangular parallelepiped.

6. The broadband antenna unit as claimed in claim 5, wherein said antenna element is disposed on a side of one side edge side of said ground plate; and wherein said broadband antenna unit has a feeding point between said ground plate and said antenna element that is located at a feeding position apart from said one side edge by a predetermined distance.

7. The broadband antenna unit as claimed in claim 6, wherein a ratio between a width of said ground plate and said predetermined distance is substantially 5:2 when a ratio between the width of said ground plate and a width of said folded plate-shaped monopole antenna portion is 2:1.

8. The broadband antenna unit as claimed in claim 5, wherein said folded plate-shape monopole antenna portion has first and second side edges opposite to each other, and wherein said first conductive plate has a notch at a tip portion thereof in the first side edge side.

9. A broadband antenna unit comprising:

a ground plate;

an antenna element disposed in the vicinity of an end of said ground plate; and a circuit board for mounting said antenna element thereon;

wherein said antenna element comprises:

a folded plate-shaped monopole antenna portion having a U-shape in cross section;

a first conductive element extending from a first location of said folded plate-shaped monopole antenna portion; and a second conductive element extending from a second location of said folded plate-shaped monopole antenna portion;

wherein said folded plate-shaped monopole antenna portion covers a first frequency band, said second conductive element covers a second frequency band lower than the first frequency band, and a combination of said first conductive element and said second conductive element covers a third frequency band lying between the first frequency band and the second frequency band.

10. The broadband antenna unit as claimed in claim 9, wherein the first frequency band contains a UWB (Ultra Wide Band) band, the second frequency band contains a GSM (Global System for Mobile communications) band, and the third frequency band contains a DCS (Digital Communication System) band, a PCS (Personal Communication Services) band, and an UMTS (Universal Mobile Telecommunications System) band.

* * * * *